US005603861A

United States Patent [19]

Umamori et al.

[11] Patent Number: 5,603,861

[45] Date of Patent: Feb. 18, 1997

[54] ELECTROVISCOUS FLUID MIXED WITH ESTERIFIED SILICA FINE PARTICLES AND POLYHYDRIC ALCOHOL

[75] Inventors: Nobuharu Umamori; Tetsuo Miyamoto; Makoto Kanbara; Hirotaka Tomizawa, all of Ohigmachi, Japan

[73] Assignee: Tonen Corporation, Tokyo, Japan

[21] Appl. No.: 424,522

[22] PCT Filed: Sep. 28, 1994

[86] PCT No.: PCT/JP94/01592

§ 371 Date: May 26, 1995

§ 102(e) Date: May 26, 1995

[87] PCT Pub. No.: WO95/09221

PCT Pub. Date: Apr. 6, 1995

[30] Foreign Application Priority Data

Sep. 28, 1993 [JP] Japan ..... 5-240780

[51] Int. Cl.[6] ..... C10M 171/00; C10M 169/04

[52] U.S. Cl. ..... 252/78.3; 252/73; 252/74; 252/572

[58] Field of Search ..... 252/78.3, 572, 252/73, 74

[56] References Cited

U.S. PATENT DOCUMENTS

| | | | |
|---|---|---|---|
| 2,657,149 | 10/1953 | Iler | 106/308 |
| 3,047,507 | 7/1962 | Winslow | 252/75 |
| 3,397,147 | 8/1968 | Martinek | 252/78.3 |
| 3,412,031 | 11/1968 | Martinek et al. | 252/75 |
| 5,075,021 | 12/1991 | Carlson et al. | 252/73 |

FOREIGN PATENT DOCUMENTS 1-253110 10/1989 Japan .

*Primary Examiner*—Christine Skane

*Attorney, Agent, or Firm*—Armstrong, Westerman, Hattori, McLeland & Naughton

[57] ABSTRACT

An electroviscous fluid wherein an electrically insulating fluid is mixed with silica fine particles having esterified surfaces, and a polyhydric alcohol. Thus, it is possible to provide an electroviscous fluid which is excellent in dispersion stability and shelf stability, free from aggregation of particles even under heating conditions and capable of manifesting high electroviscous effect.

12 Claims, 4 Drawing Sheets

ELECTROVISCOUS FLUID MIXED WITH ESTERIFIED SILICA FINE PARTICLES AND POLYHYDRIC ALCOHOL

TECHNICAL FIELD

The present invention relates to an electroviscous fluid which is usable for electric control of a variable damper, an engine mount, a bearing damper, a clutch, a valve, a shock absorber, a display device, etc.

BACKGROUND ART

Electroviscous fluids (electro-rheological fluids) whose viscosity changes upon application of a voltage have been known for a long time (Duff, A. W. Physical Review Vol. 4, No. 1 (1896) 23). At the beginning of the study on electroviscous fluids, attention was paid to systems consisting only of a liquid. Therefore, the electroviscous effect obtained therefrom was insufficient. However, the subject of the study shifted to the electroviscous fluids of solid dispersed systems thereafter, and it has become possible to obtain considerable electroviscous effect.

Regarding the viscosity increase effect (ER effect) manifesting mechanism in electroviscous-fluids, Klass, for example, states that particles which form a dispersoid in an electroviscous fluid cause induced polarization of the double layer in an electric field, and the induced polarization accounts for the manifestation of the ER effect (Klass, D. L., et al., J. of Applied Physics, Vol. 38, No. 1 (1967) 67). Let us explain the mechanism on the basis of the electric double layer: Ions which are adsorbed around a dispersoid (silica gel or the like) are uniformly disposed on the outer surface of the dispersoid when E (electric field) is 0. However, when E (electric field) assumes a finite value, the ion distribution is deviated, causing the particles to exert electrostatic action on each other in the electric field. Thus, the particles form a bridge between the electrodes, thus manifesting shear resistance to stress, that is, ER effect.

Winslow proposed an electroviscous fluid using a paraffin, silica gel powder, and water as a polarizing agent (Winslow, W. M, J. of Applied Physics, Vol. 20 (1949) 1137). By virtue of the Winslow's study, the electroviscous effect of electroviscous fluids is called "Winslow effect".

In such an electroviscous fluid, porous solid particles are used as a dispersoid. However, such a dispersoid involves a problem in terms of dispersibility: If the electroviscous fluid is allowed to stand for a long time, a solid precipitate is formed. Under the temperature conditions of about 100° C. the electroviscous fluid forms a gel-like substance on standing for only a short time of from several minutes to several hours, resulting in a failure to function as an electroviscous fluid. To improve the dispersion stability, the conventional practice is to finely divide solid particles dispersed in the electroviscous fluid to the level of the critical particle diameter and to add a dispersant such as polybutenyl succinic acid imide. However, it has been proved that polybutenyl succinic acid imide has a high molecular weight, and since the molecular length of the dispersant is excessively long in comparison to the particle diameter, it is impossible to obtain sufficient attraction force between the particles and hence impossible to obtain the desired electroviscous effect. In terms of thermal setting also, the conventional electroviscous fluids are considered likely to cause aggregation of particles under heating conditions.

Japanese Patent Application Post-Examination Publication No. 45-10048 discloses an electroviscous fluid which is a dispersion of esterified silica particles in an electrically insulating fluid having a high base viscosity. The esterified silica particles have a particle diameter of from 0.04 um to 10 um, and have about 0.5 to 1.5 silica-bonded OR groups per $nm^2$ of the particle surface, and from 1 to 3 molecules of free water, wherein R is an ester residue of a polyoxy-substituted ester or polyoxyalcohol having a molecular weight of from about 130 to 400. However, silica particles esterified with a polyhydric alcohol are still likely to aggregate, and involve the problems that the degree of esterification is low, and the standing stability is inferior. Further, since water is used as a polarization promoter, the electroviscous effect under high-temperature conditions is unstable. In addition, if silica particles having a relatively large particle diameter are dispersed in an electrically insulating fluid having a low base viscosity, precipitation is likely to occur, giving rise to a problem.

An object of the present invention is to provide an electroviscous fluid which uses a polyhydric alcohol as a polarization promoter in a non-aqueous system, and which is excellent in dispersion stability and shelf stability, free from aggregation of particles even under heating conditions and capable of manifesting high electroviscous effect.

DISCLOSURE OF THE INVENTION

The electroviscous fluid of the present invention is characterized in that an electrically insulating fluid is mixed with silica fine particles each having a surface esterified with a monohydric alcohol having an alkyl group with 8 or more carbon atoms as a main chain, and a polyhydric alcohol.

The electroviscous fluid of the present invention is further characterized in that the monohydric alcohol has an alkyl group with from 8 to 48 carbon atoms as a main chain.

The electroviscous fluid of the present invention is further characterized in that the silica fine particles have a particle diameter in the range of from 0.01 μm to 4.0 μm.

The electroviscous fluid of the present invention is further characterized in that the silica fine particles have a particle diameter in the range of from 0.01 μm to 1.5 μm.

The electroviscous fluid of the present invention is further characterized in that the silica fine particles have a particle diameter in the range of from 0.01 μm to 0.5 μm.

The electroviscous fluid of the present invention is further characterized in that the silica fine particles have a particle diameter in the range of from 0.5 μm to 4.0 μm, and the monohydric alcohol has a straight-chain alkyl group with from 12 to 48 carbon atoms as a main chain.

The electroviscous fluid of the present invention is further characterized in that the silica fine particles have a particle diameter in the range of from 0.01 μm to 0.5 μm, and the monohydric alcohol has a straight-chain alkyl group with from 8 to 32 carbon atoms as a main chain.

The electroviscous fluid of the present invention is further characterized in that the number of esterified silanol groups bonded to the silica fine particle surface is in the range of from $1.8/nm^2$ to $6.0/nm^2$.

The electroviscous fluid of the present invention is further characterized in that the number of esterified silanol groups bonded to the silica fine particle surface is in the range of from $2.0/nm^2$ to $5.5/nm^2$.

If a polyhydric alcohol is used as a polarization promoter to form a non-aqueous system, an electroviscous fluid is obtained which is excellent in the durability of electroviscous effect. The electroviscous fluid of the present invention is based on the finding that if silica fine particles whose surfaces have been subjected to esterification with a monohydric alcohol having an alkyl group with 8 or more carbon atoms as a main chain are used as a dispersoid in the non-aqueous system, it is possible to obtain an electroviscous fluid which is even more excellent in dispersibility, and which will not set under heating conditions.

Although it is not clear why such an advantageous effect can be obtained, the reason therefor may be considered that an electroviscous fluid which is excellent in dispersibility can be obtained by finely dividing silica particles to the level of the critical particle diameter, and that since the silanol groups on the silica particle surface have been esterified with a hydrocarbon group having an appropriate molecular length, sufficient attraction force acts between particles, thus making it possible to obtain high electroviscous effect. It is also considered that since the bond will not break up even under heating conditions, it is possible to prevent aggregation of particles.

BEST MODE FOR CARRYING OUT THE INVENTION

Figure 1:
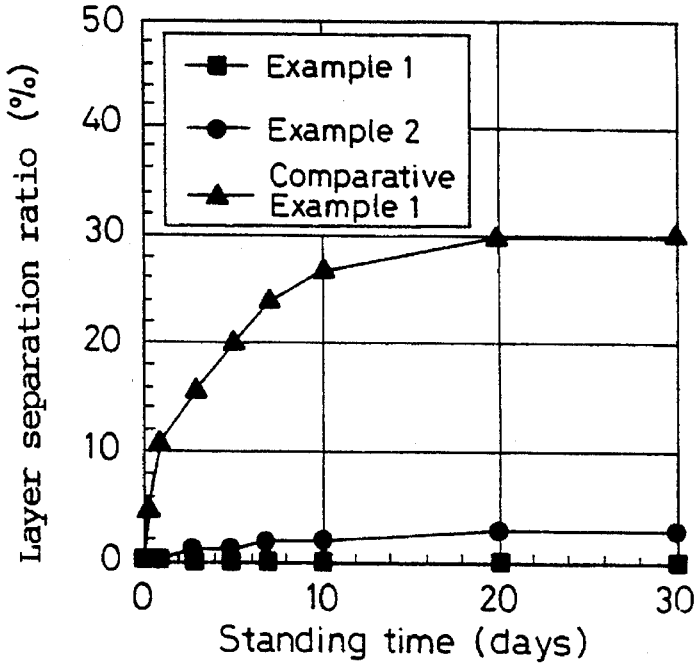
FIG. 1 is a graph for explaining the relationship between the particle diameter of esterified silica fine particles and the dispersion stability in an electroviscous fluid.

Silica fine particles in the present invention have a particle diameter in the range of from 0.01 μm to 4 μm, preferably from 0.01 μm to 1.5 μm, more preferably from 0.01 μm to 0.5 μm, and most preferably from 0.01 μm to 0.1 μm.

Silanol groups on the surfaces of the silica fine particles have been esterified with a monohydric alcohol having an alkyl group with 8 or more carbon atoms as a main chain.

Examples of usable monohydric alcohols are aliphatic alcohols having an alkyl group with from 8 to 48 carbon atoms as a main chain. The alkyl group is preferably a straight-chain alkyl group which preferably has no functional group in the carbon chain.

Examples of aliphatic alcohols are octanol, nonanol, decanol, undecanol, dodecanol, tridecanol, tetradecanol, pentadecanol, hexadecanol, heptadecanol, octadecanol, nonadecanol, eicosanol, tetracosanol, hexacosanol, triacontanol, dotriacontanol, hexatriacontanol, etc.

In addition to such monohydric aliphatic alcohols, it is also possible to use aromatic alcohols having an aromatic ring in a main or side chain of an alkyl group having from 1 to 40 carbon atoms. Examples of such aromatic alcohols are benzyl alcohol, phenethyl alcohol, tolyl methanol, ethyl benzyl alcohol, etc.

It is also possible to use polyether alcohols having from 5 to 26 carbon atoms, for example, diethylene glycol monomethyl ether, diethylene glycol monoethyl ether, triethylene glycol monomethyl ether, triethylene glycol monoethyl ether, etc.

Regarding the relationship between the particle diameter of the silica fine particles and the molecular chain length of the ester group, the molecular chain length should be adjusted according to the particle diameter of the silica fine particles. In order to obtain an electroviscous fluid which is excellent in both dispersibility and electroviscous effect, it is preferable to use a monohydric alcohol having a relatively long molecular length when the particle diameter of the silica fine particles is relatively large. When the particle diameter of the silica fine particles is relatively small, it is preferable to use a monohydric alcohol having a relatively short molecular chain. For example, when the particle diameter of the silica fine particles is n the range of from 0.5 μm to 4.0 μm, it is preferable to use a monohydric alcohol having an alkyl group with from 12 to 48 carbon atoms, more preferably from 12 to 36 carbon atoms, as a main chain. When the particle diameter of the silica fine particles is in the range of from 0.01 μm to 0.5 μm, it is preferable to use a monohydric alcohol having an alkyl group with from 8 to 32 carbon atoms, more preferably from 8 to 26 carbon atoms as a main chain.

A method of esterifying the surfaces of silica fine particles will be explained below. It is necessary for the silica fine particles that the particle diameter should fall within the range of from 0.01 μm to 4 μm in terms of primary particle diameter or in an aggregated state. Silica fine particles having a particle size in the above range need no finely dividing process. However, silica fine particles having a relatively large particle diameter should be dispersed in an organic solvent and subjected to ball milling, thereby adjusting the particle diameter so that it falls within the range of from 0.01 μm to 4 μm.

Esterification is carried out by allowing silica fine particles having such a particle diameter and an alcohol to react with each other under heating reflux conditions. It is preferable to azeotropically remove water generated during the reaction.

The number of silanol groups bonded to the silica fine particle surface is equivalent to the yield in an ordinary chemical reaction, and it can be changed by adjusting reaction conditions (reaction temperature, reaction time, amount of alcohol added, etc.) in the esterification reaction. The number of bonded groups can be obtained by elemental analysis and measurement of a surface area. The number of esterified silanol groups bonded to the silica fine particle surface is preferably in the range of from 1.8/nm$^2$ to 6.0/nm$^2$, more preferably from 2.0/nm$^2$ to 5.5/nm$^2$. As the number of bonded groups increases, the dispersion stability increases, but the electroviscous effect reduces. As the number of bonded groups decreases, the standing stability reduces.

The electroviscous fluid of the present invention preferably contains silica fine particles in the proportion of from 0.1% to 50% by weight, more preferably from 3% to 30% by weight. If the silica fine particle content exceeds 50% by weight, the electroviscous effect reduces, unfavorably.

A polyhydric alcohol or a partial derivative thereof is added as a polarization promoter to the electroviscous fluid of the present invention. Examples of usable polyhydric alcohols are dihydric alcohols, trihydric alcohols, e.g., ethylene glycol, glycerol, propanediol, butanediol, pentanediol, hexanediol, polyethylene glycol having from 1 to 14 ethylene oxide units, those which are represented by the general formula $R[(OC_3H_6)_mOH]_n$ (wherein R is hydrogen or a polyhydric alcohol residue, m is an integer of 1 to 17, and n is an integer of 1 to 6), and those which are represented by the general formula $R—CH(OH)(CH_2)_nOH$ (wherein R is hydrogen or $CH_3(CH_2)_m$— group, and m+n is an integer of 2 to 14). Among these polyhydric alcohols, triethylene glycol, tetraethylene glycol, and polyethylene glycol are particularly preferable.

Partial derivatives of polyhydric alcohols usable in the present invention are those which have at least one hydroxyl group. Examples of such partial derivatives are partial ethers in which some of terminal hydroxyl groups of the above-mentioned polyhydric alcohols have been replaced by methyl groups, ethyl groups, propyl groups, butyl groups, alkyl-substituted phenyl groups (the alkyl group replaced by the phenyl group has from 1 to 25 carbon atoms), etc., and partial esters in which someof terminal hydroxyl groups of the above-mentioned polyhydric alcohols have been esterified with acetic acid, propionic acid, butyric acid, etc.

These polyhydric alcohols or partial derivatives thereof are usually used in the proportion of from 1% to 100% by weight, preferably from 2% to 80% by weight, with respect to the silica fine particles. If the amount of polyhydric alcohol or partial derivative added to the silica fine particles is less than 1% by weight, the ER effect reduces, whereas, if it exceeds 100% by weight, it becomes easy for an electric current to flow, undesirably.

Examples of electrically insulating fluids used in the present invention are mineral oils and synthetic lubricating oils. Specific examples are paraffin mineral oils, naphthene mineral oils, poly-α-olefin, polyalkylene glycol, ester oil, diester, polyol ester, phosphoric ester, fluorine oil, alkylbenzene, alkyldiphenyl ether, alkylbiphenyl, alkylnaphthalene, polyphenyl ether, and synthetic hydrocarbon oil. Particularly referable examples are mineral oil, alkylbenzene, ester oils such as diester and polyol ester, poly-α-olefin, etc. The viscosity of the electrically insulating fluid at 40° C. may be in the range of from 1 cST to 300 cSt. However, when the silica fine particles of the present invention are used, particularly excellent dispersibility is exhibited when the viscosity of the electrically insulating fluid is relatively low, i.e., in the range of from 1 cSt to 20 cSt.

If necessary, an acid, salt or base component may be added to the electroviscous fluid of the present invention. Examples of acids usable as an acid component are inorganic acids such as sulfuric acid, hydrochloric acid, nitric acid, perchloric acid, chromic acid, phosphoric acid, boric acid, etc., and organic acids such as acetic acid, formic acid, propionic acid, butyric acid, isobutyric acid, valeric acid, oxalic acid, malonic acid, etc. Examples of usable salts are compounds formed from a metal or a basic group ($NH_4^+$, $N_2H_5^+$, etc.) and an acid radical. Particularly preferable compounds are those which dissolve and dissociate in a polyhydric alcohol or polyhydric alcohol partial derivative system, for example, halides of alkali metals or alkaline earth metals, which form typical ionic crystal, or alkali metal salts of organic acids. Examples of this type of salt include LiCl, NaCl, KCl, $MgCl_2$, $CaCl_2$, $BaCl_2$, LiBr, NaBr, KBr, $MgBr_2$, LiI, NaI, KI, $AgNO_3$, $Ca(NO_3)_2$, $NaNO_2$, $NH_4NO_3$, $K_2SO_4$, $Na_2SO_4$, $NaHSO_4$, $(NH_4)_2SO_4$, and alkali metal salts of formic acid, acetic acid, oxalic acid, succinic acid, etc. Bases usable in the present invention are hydroxides of alkali metals or alkaline earth metals, carbonates of alkali metals, and amines. Among these bases, those which dissolve and dissociate in a polyhydric alcohol or a polyhydric alcohol partial derivative are particularly preferable. Examples of this type of base include NaOH, KOH, $Ca(OH)_2$, $Na_2CO_3$, $NaHCO_3$, $K_3PO_4$, $Na_3PO_4$, aniline, alkylamine, ethanolamine, etc. It should be noted that the above-mentioned salts and bases may be used in combination.

Such an acid, salt or base component enables the polarization effect to be enhanced. However, the polarization effect can be even more enhanced by using an acid, salt or base component in combination with a polyhydric alcohol and/or a polyhydric alcohol partial derivative. It is preferable to use an acid, salt or base component in the proportion of from 0% to 5% by weight with respect to the whole electroviscous fluid. If the content of the acid, salt or base component exceeds 5% by weight, it becomes easy for an electric current to flow, resulting in an increase in the power consumption, undesirably.

If necessary, an ashless dispersant may be added to the electroviscous fluid of the present invention. Addition of an ashless dispersant enables the base viscosity of the electroviscous fluid to be lowered, thus making it possible to widen the application range of a machine system that uses the electroviscous fluid. Examples of usable ashless dispersants are sulfonates, phenates, phosphonates, succinic acid imides, amines, nonionic dispersants, etc. Specific examples include magnesium sulphonate, calcium sulphonate, calcium phosphonate, polybutenyl succinic acid imide, sorbitan monooleate, sorbitan sesquioleate, etc. Among these compounds, polybutenyl succinic acid imide is particularly preferable. These ashless dispersants are used in the proportion of from 0% to 20% by weight with respect to the whole electroviscous fluid.

Further, a surface-active agent is preferably added to the electroviscous fluid of the present invention according to need. Surface-active agents usable in the present invention are nonionic surface-active agents, anionic surface-active agents, cationic surface-active agents, and amphoteric surface-active agents.

Examples of nonionic surface-active agents are polyoxyethylene alkyl ether, polyoxyethylene alkyl phenyl ether, polyoxyethylene alkyl amide, polyoxyethylene-polyoxypropylene glycol, polyoxyethylene-polyoxypropylene glycol ethylenediamine, polyoxyethylene fatty ester, polyoxyethylene-polyoxypropylene glycol fatty ester, polyoxyethylene sorbitan fatty ester, ethylene glycol fatty ester, propylene glycol fatty ester, glycerol fatty ester, pentaerythritol fatty ester, sorbitan fatty ester, sucrose fatty ester, fatty acid ethanol amide, etc.

Examples of anionic surface-active agents are fatty acid alkali salt, alcohol sulfate, polyoxyethylene alkyl ether sulfate, polyoxyethylene alkyl phenyl ether sulfate, fatty acid polyhydric alcohol sulfate, sulfated oil, fatty acid anilide sulfate, petroleum sulfonate, alkylnaphthalene sulfonate, dinaphthylmethane sulfonate, alkyldiphenyl ether disulfonate, polyoxyethylene alkyl ether phosphate, etc.

Cationic surface-active agents include those which have weak cationic properties, and those which have strong cationic properties. Examples of usable cationic surface-active agents having weak cationic properties are alkylamines, and adducts of alkylamines with polyoxyalkylene, for example, octylamine, dibutylamine, trimethylamine, oleylamine, stearylamine, adducts of these amines with from 5 to 15 mols of ethylene oxide, and adducts of the amines with from 5 to 15 mols of propylene oxide. Usable cationic surface-active agents having weak cationic properties further include adducts of polyamines such as alkylenediamine, dialkylenetriamine, etc., which may be replaced by a higher alkyl group, with polyoxyalkylene, for example, adducts of ethylenediamine, diethylenetriamine, etc. with from 0 to 100 mols of ethylene oxide, block or random adducts of ethylenediamine, diethylenetriamine, etc. with from 0 to 100 mols of ethylene oxide and from 0 to 100 mols of propylene oxide, and adducts of oleylpropylenediamine or stearylpropylenediamine with from 0 to 100 mols of ethylene oxide. Adducts of higher fatty amides with polyoxyalkylene are also usable as cationic surface-active agents having weak cationic properties. Examples of such adducts include adducts of oleic amide or stearic acid amide with from 5 to 15 mols of ethylene oxide, and adducts of oleic amide or stearic acid amide with from 5 to 15 mols of propylene oxide. Examples of usable cationic surface-active agents having strong cationic properties are decanoyl chloride, alkyl ammonium salt, alkyl benzyl ammonium salt, alkyl amine salt, etc. Specific examples include trimethylammonium cetyl chloride, trimethylammonium stearyl chloride, trimethyl ammonium behenyl chloride, dimethyl ammonium distearyl chloride, dimethylbenzylammonium stearyl chloride, diethylaminoethyl ammonium stearate, coconut amine acetate, stearylamine acetate, coconut amine hydrochloride, stearylamine hydrochloride, etc. In the case of a cationic surface-active agent having strong cationic properties, the electrical conductivity of the electroviscous fluid becomes high when the working temperature at which the electroviscous fluid is used is high, i.e., nearly 100° C. Therefore, it is particularly preferable to use a cationic surface-active agent having weak cationic properties among the above-mentioned surface-active agents. By using such a surface-active agent, it is possible to maintain low electrical conductivity during the operation over a wide temperature range of from a low-temperature region to a high-temperature region.

Regarding the content of surface-active agent, it is preferable to use a surface-active agent in the proportion of from 0% to 10% by weight, more preferably from 0.1% to 5% by weight, in the electroviscous fluid. If the surface-active agent content exceeds 10% by weight, the electrical conductivity becomes unfavorably high.

If necessary, other additives, such as an oxidation inhibitor, a corrosion inhibitor, an antiwear agent, an extreme-pressure additive, anti-foaming agent, etc., may be added to the electroviscous fluid of the present invention.

The oxidation inhibitor is added for the purpose of preventing oxidation of the electrically insulating liquid and also oxidation of a polyhydric alcohol or a polyhydric alcohol partial derivative, which is used as a polarization promoter. It is preferable to use an oxidation inhibitor which is inactive with respect to the polarization promoter and dispersoid used. It is possible to use phenol and amine oxidation inhibitors which are commonly used. Specific examples of usable phenol oxidation inhibitors are 2·6-di-t-butyl para-cresol, 4·4'-methylenebis(2·6-di-t-butylphenol), 2·6-di-t-butylphenol, etc. Specific examples of amine oxidation inhibitors are dioctyldiphenylamine, phenyl-α-naphthylamine, alkyldiphenylamine, N-nitrosodiphenylamine, etc. Such an oxidation inhibitor may be used in the proportion of from 0% to 10% by weight, preferably 0.1% to 2.0% by weight, with respect to the weight of the whole electroviscous fluid. If the oxidation inhibitor content exceeds 10% by weight, problems arise, i.e., deterioration of hue, occurrence of turbidity, generation of sludge, increase of viscosity.

A corrosion inhibitor may be added. However, it is preferable to use a corrosion inhibitor which is inactive with respect to the polarization promotor and dispersoid used. Specific examples of usable corrosion inhibitors are nitrogen compounds, i.e., benztriazole and derivatives thereof, imidazoline, pyrimidine derivatives, etc., sulfur and nitrogen containing compounds, i.e., 1.3.4-thiadiazole polysulfide, 1.3.4-thiadiazolyl-2.5-bisdialkyldithiocarbamate, 2-(alkyldithio)benzimidazole, etc. It is also possible to use β-(o-carboxybenzylthio)propionitrile or propionic acid. Such a corrosion inhibitor is preferably used in the proportion of from 0% to 10% by weight, more preferably from 0.01% to 1.0% by weight, with respect to the whole electroviscous fluid. If the corrosion inhibitor content exceeds 10% by weight, problems arise, i.e., deterioration of hue, occurrence of turbidity, generation of sludge, increase of viscosity, etc.

The present invention will be explained below by way of specific examples.

EXAMPLE 1

60 g of silica particles ("Sylysia 310" manufactured by Fuji Silysia Chemical (k.k.); average particle diameter: 1.4 μm) was mixed with 200 g of toluene, and the resulting mixture was subjected to milling for 6 hours in a ball mill (using zirconia beads; 250 rpm), thereby dividing the silica particles into fine particles having an average particle diameter of 0.1 μm. 200 g of oleyl alcohol ($C_{18}H_{35}OH$) was added to the above mixture, and the alcohol and the silica fine particles were allowed to react with each other under reflux at 111° C. for 6 hours, thereby carrying out esterification reaction. During the reaction, water was azeotropically removed.

The reaction product thus obtained was washed with carbon tetrachloride, and the particles were separated by using an ultracentrifugal separator (18,000 rpm×60 min). The washing process and the separating process were repeated until the unreacted alcohol was removed. Carbon tetrachloride was removed by using a rotary evaporator, thereby obtaining 37 g of oleyl-esterified silica particles. The surface area of the particles thus obtained was 194 $m^2/g$ (BET method), and the elemental analysis value (carbon) was 14%. It was found from these values that the number of esterified silanol groups bonded to the silica surface was $3.0/nm^2$.

An electroviscous fluid having the following composition was prepared by using the silica particles obtained as described above.

Composition of Electroviscous Fluid

Esterified silica fine particles—15wt %

Triethylene glycol—3wt %

Alkylbenzene (4.3 cSt at 40° C.)—82wt %

An electric current flowing through the obtained electroviscous fluid under application of an AC electric field of 50 Hz and 2 KV/mm was measured in the temperature range of from room temperature (25° C.) to 100° C. The measured current value was in the range of from 0.1 mA to 0.3 mA. Thus, the current value was extremely low.

EXAMPLE 2

60 g of silica particles ("Sylysia 440" manufactured by Fuji Silysia Chemical (k.k.); average particle diameter: 3.5 μm) and 200 g of oleyl alcohol ($C_{18}H_{350}H$) were mixed with 200 g of toluene, and the alcohol and the silica particles were allowed to react with each other under reflux at 111° C. for 6 hours, thereby carrying out esterification reaction. During the reaction, water was azeotropically removed.

The reaction product thus obtained was washed with carbon tetrachloride, and the particles were separated by using an ultracentrifugal separator (18,000 rpm×60 min). The washing process and the separating process were repeated until the unreacted alcohol was removed. Carbon tetrachloride was removed by using a rotary evaporator, thereby obtaining 48 g of oleyl-esterified silica particles.

The surface area of the particles thus obtained was 216 $m^2/g$ (BET method), and the elemental analysis value (carbon) was 16%. It was found from these values that the number of esterified silanol groups bonded to the silica surface was 3.1/$nm^2$.

An electroviscous fluid was prepared by using the silica particles obtained as described above in the same way as in Example 1.

COMPARATIVE EXAMPLE 1

60 g of silica particles ("Sylysia 450" manufactured by Fuji Silysia Chemical (k.k.); average particle diameter: 5.2 μm) and 200 g of oleyl alcohol ($C_{18}H_{35}OH$) were mixed with 200 g of toluene, and the alcohol and the silica particles were allowed to react with each other under reflux at 111° C. for 6 hours, thereby carrying out esterification reaction. During the reaction, water was azeotropically removed.

The reaction product thus obtained was washed with carbon tetrachloride, and the particles were separated by using an ultracentrifugal separator (18,000 rpm×60 min). The washing process and the separating process were repeated until the unreacted alcohol was removed. Carbon tetrachloride was removed by using a rotary evaporator, thereby obtaining 48 g of oleyl-esterified silica particles.

The surface area of the particles thus obtained was 203 $m^2/g$ (BET method), and the elemental analysis value (carbon) was 15%. It was found from these values that the number of esterified silanol groups bonded to the silica surface was 3.1/$nm^2$.

An electroviscous fluid was prepared by using the silica particles obtained as described above in the same way as in Example 1.

The effect of the silica particle diameter on dispersibility was measured for each of the electroviscous fluids prepared in Examples 1 and 2 and Comparative Example 1 by the following evaluation method. FIG. 1 shows the results of the measurement.

(1) Dispersibility: Each electroviscous fluid was put in a measuring cylinder, and allowed to stand at room temperature. During the standing, particles in some electroviscous fluids were sedimented, and a layer consisting only of oil was formed in the upper part of the cylinder. The proportion (%) of the upper layer consisting only of oil to the whole fluid was defined as the layer separation ratio, and the relationship between the layer separation ratio and the standing time (number of days) was obtained.

As will be understood from FIG. 1, if silica fine particles having a particle diameter exceeding 4 μm are used, the speed of layer separation is high. Accordingly, an electroviscous fluid containing such silica fine particles is not suitable for use.

EXAMPLE 3

Silica particles in which the number of esterified silanol groups bonded to the particle surface was in the range of from 2.7 to 3.3/$nm^2$ were obtained in the same way as in Example 1 except that 1-octanol ($C_8H_{17}OH$), 1-tetracosanol ($C_{24}H_{49}OH$), 1-dotriacontanol ($C_{32}H_{65}OH$), and 1-hexatriacontanol ($C_{36}H_{73}OH$) were respectively used in the same amount in place of the oleyl alcohol in Example 1.

Electroviscous fluids were prepared by using the silica particles thus obtained in the same way as in Example 1.

For each electroviscous fluid, the effect of the main chain length of the alkyl group in the alcohol on the dispersibility of the silica fine particles and on the electroviscous effect (viscosity increase factor) was evaluated.

The evaluation methods were as follows:

(1) Dispersibility: Each electroviscous fluid was put in a measuring cylinder, and allowed to stand for 30 days at room temperature. During the standing, particles in some electroviscous fluids were sedimented, and a layer consisting only of oil was formed in the upper part of the cylinder. The proportion (%) of the upper layer consisting only of oil, which was formed during the standing, to the whole fluid was defined as the layer separation ratio.

(2) Viscosity increase factor: Each electroviscous fluid was filled in a double-cylinder rotational viscometer, and an AC electric field (50 Hz; 2Kv/mm) was applied between the inner and outer cylinders at 40° C. Under these conditions, the viscosity increase factor at the same shear rate (600 $sec^{-1}$) was measured.

Figure 2:
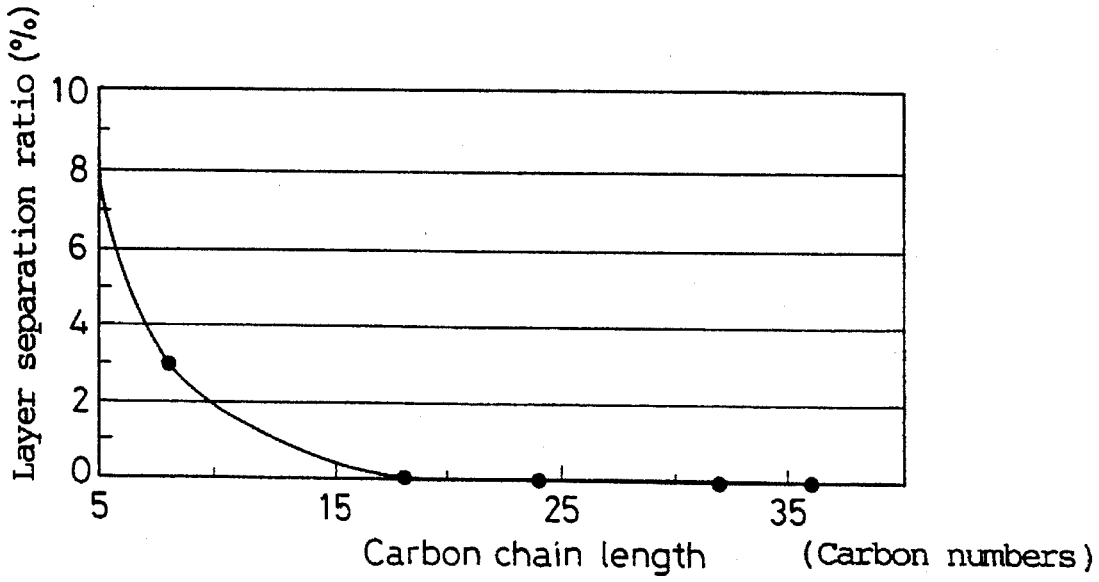
FIG. 2 is a graph showing the relationship between the main chain length of an alkyl group in an alcohol used to esterify silica fine particle surfaces and the layer separation ratio in the electroviscous fluid.
Figure 3:
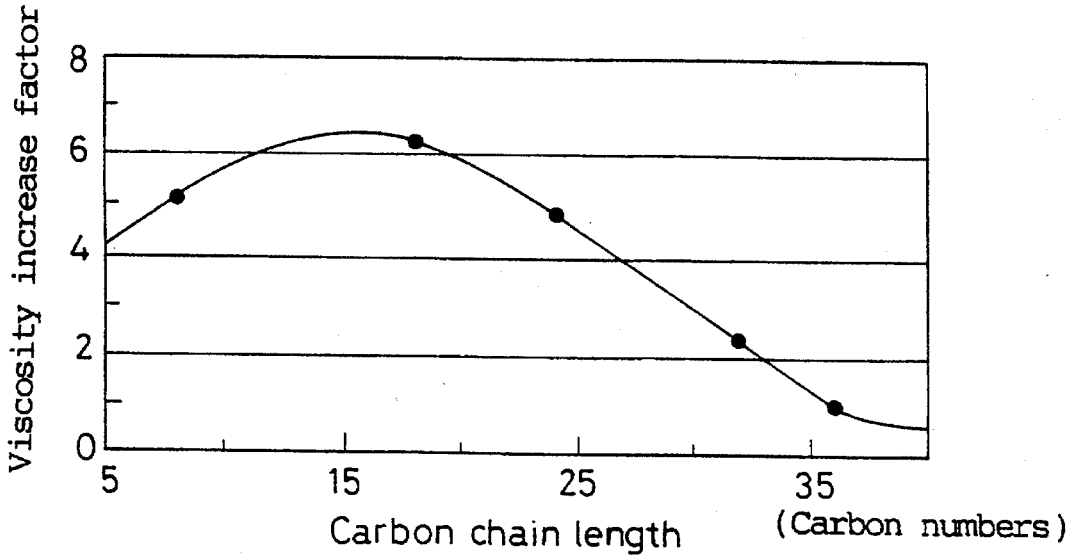
FIG. 3 is a graph showing the relationship between the main chain length of an alkyl group in an alcohol used to esterify silica fine particle surfaces and the viscosity increase factor in the electroviscous fluid.

FIG. 2 shows the results of measurement for dispersibility, and FIG. 3 shows the results of measurement for the viscosity increase factor.

As shown in FIG. 2, layer separation occurred only when 1-octanol (number of carbon atoms: 8) was used for esterification. However, the lower layer that was separated was readily redispersed by slight vibration.

It will also be understood from FIG. 3 that viscosity increase effect can be obtained by carrying out esterification using an alcohol having an alkyl group with from 8 to 36 carbon atoms. That is, it will be understood from FIGS. 2 and 3 that as the number of carbon atoms increases, the dispersion stability becomes excellent, as shown in FIG. 2, but the viscosity increase effect reduces, as shown in FIG. 3.

When an alcohol having an alkyl group with less than 8 carbon atoms was used for esterification, the speed of layer separation was unfavorably high. Therefore, the viscosity increase effect was not stabilized, and evaluation could not be made.

EXAMPLE 4

Silica fine particles were produced in the same way as in Example 1 except that the reaction conditions were changed, thereby obtaining silica particles in which the number of esterified silanol groups bonded to the silica surface was 2.0/nm$^2$.

An electroviscous fluid was prepared by using the thus obtained silica particles in the same way as in Example 1.

EXAMPLE 5

Silica fine particles were produced in the same way as in Example 1 except that the reaction conditions were changed, thereby obtaining silica particles in which the number of esterified silanol groups bonded to the silica surface was 5.5/nm$^2$.

An electroviscous fluid was prepared by using the thus obtained silica particles in the same way as in Example 1.

COMPARATIVE EXAMPLE 2

Silica fine particles were produced in the same way as in Example 1 except that the reaction conditions were changed, thereby obtaining silica particles in which the number of esterified silanol groups bonded to the silica surface was 1.5/nm$^2$.

An electroviscous fluid was prepared by using the thus obtained silica particles in the same way as in Example 1.

COMPARATIVE EXAMPLE 3

Silica fine particles were produced in the same way as in Example 1 except that the reaction conditions were changed, thereby obtaining silica particles in which the number of esterified silanol groups bonded to the silica surface was 8.0/nm$^2$.

An electroviscous fluid was prepared by using the thus obtained silica particles in the same way as in Example 1.

Figure 4:
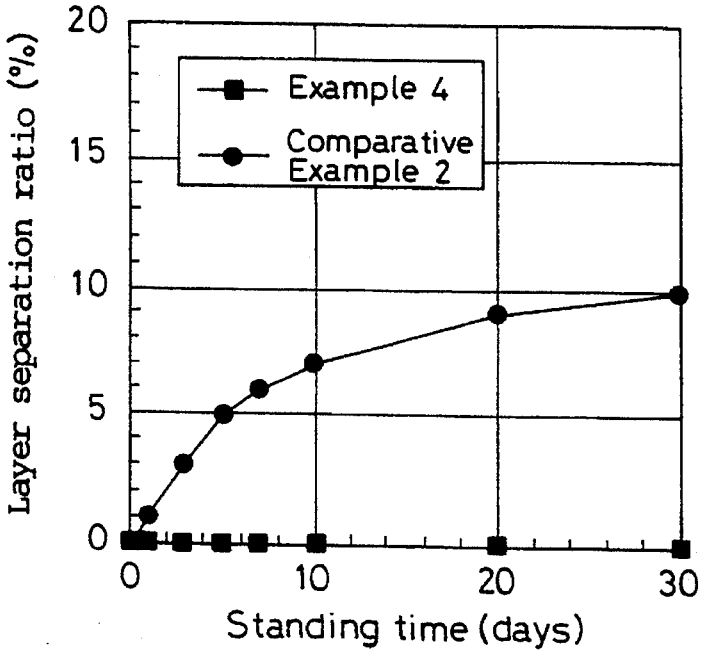
FIG. 4 is a graph for explaining the relationship between the number of ester linkage groups in esterified silica fine particles and the dispersion stability in the electroviscous fluid.

With respect to the electroviscous fluids obtained in Examples 4 and 5 and Comparative Examples 2 and 3, the dispersibility was evaluated by the dispersibility evaluating method described in Comparative Example 1, and the viscosity increase factor was evaluated by the viscosity increase factor evaluating method described in Example 3. FIG. 4 shows the results of measurement for the dispersibility, and Table 1 below shows the results of measurement for the viscosity increase factor.

It will be understood from FIG. 4 that if the number of esterified silanol groups bonded to the silica surface is small, the standing stability is inferior, and layer separation occurs.

TABLE 1

| | Viscosity increase factor |
|---|---|
| Example 5 | 2.3 |
| Comparative Example 3 | 1.1 |

It will be understood from Table 1 that if the number of esterified silanol groups bonded to the silica surface is large, the viscosity increase factor is low, and no electroviscous effect is observed. It should be noted that regarding the dispersibility of the electroviscous fluids in Example 5 and Comparative Example 3, no layer separation occurred in either of the electroviscous fluids.

COMPARATIVE EXAMPLE 4

Esterification reaction was carried out in the same way as in the preparation of silica fine particles in Example 1 except that 213 g of 1,2-octadecane diol ($HOC_{18}H_{36}OH$) was used in place of the oleyl alcohol ($C_{18}H_{35}OHO$), thereby obtaining 42 g of esterified silica fine particles.

The surface area of the particles thus obtained was 186 m$^2$/g (BET method), and the elemental analysis value (carbon) was 11%. It was found from these values that the number of esterified silanol groups bonded to the silica surface was 2.5/nm$^2$.

An electroviscous fluid was prepared by using the obtained silica particles in the same way as in Example 1, and the standing stability thereof was evaluated by the dispersibility evaluating method described in Comparative Example 1.

Figure 5:
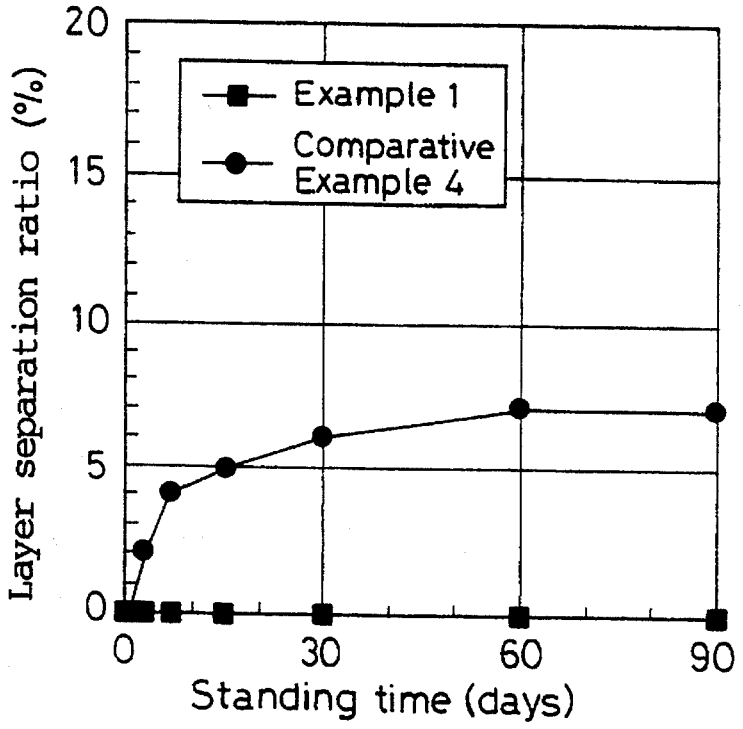
FIG. 5 is a graph for explaining the relationship between the kind of ester in esterified silica fine particles and the dispersion stability in the electroviscous fluid.

FIG. 5 shows the results of the measurement.

It will be understood from FIG. 5 that when a polyhydric alcohol is used for esterification of silica fine particles, such precipitation occurs that the precipitate is difficult to redisperse.

COMPARATIVE EXAMPLE 5

An electroviscous fluid having the following composition was prepared by using the esterified silica fine particles in Example 1.

Composition of Electroviscous Fluid

Esterified silica fine particles—15wt %

Water—0.4wt %

Alkylbenzene ( 4.3 cSt at 40° C.)—84.6wt %

Figure 6:
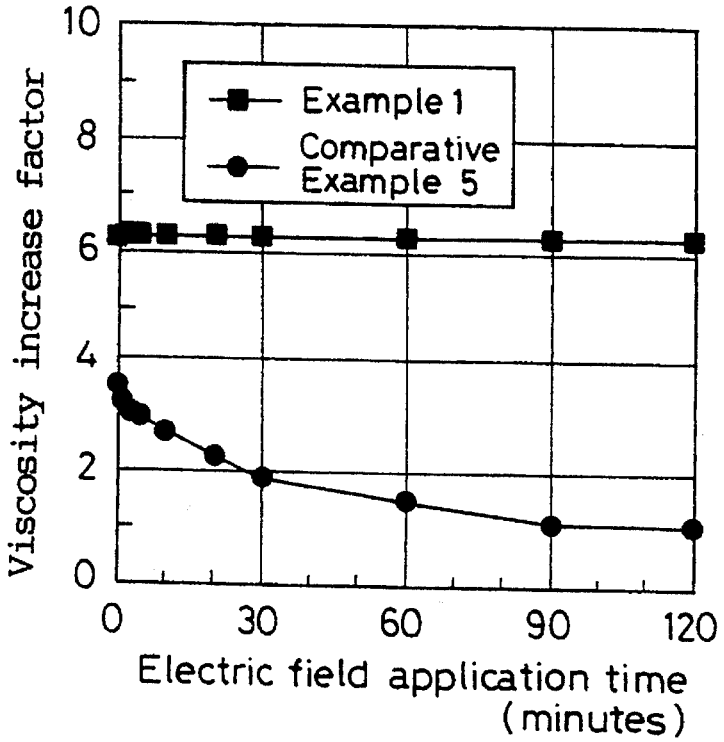
FIG. 6 is a graph for explaining the relationship between the kind of polarization promoter in an electroviscous fluid and the viscosity increase factor in the electroviscous fluid.

With respect to the electroviscous fluid thus prepared and the electroviscous fluid prepared in Example 1, the viscosity increase factor was measured under the following conditions, and the change of viscosity increase factor with time was also measured. FIG. 6 shows the results of the measurement.

Viscosity increase factor: Each electroviscous fluid was filled in a double-cylinder rotational viscometer, and an AC electric field (50 Hz; 2Kv/mm) was applied between the inner and outer cylinders at 100° C. Under these conditions, the viscosity increase factor at the same shear rate (600 sec$^{-1}$) was measured.

It will be understood from FIG. 6 that when water is used as a polarization promotor, the viscosity increase factor is small because of evaporation, and thus the electroviscous fluid using water as a polarization promotor is not suitable for use at high temperature.

COMPARATIVE EXAMPLE 6

An electroviscous fluid having the following composition was prepared:

Silica fine particles—15wt % (average particle diameter: 1.4 μm; unmodified)

Triethylene glycol—3wt %

Polybutenyl succinic acid imide—20wt %

Alkylbenzene (4.3 cSt at 40° C.)—62wt %

The layer separation ratio in the electroviscous fluid was measured by the dispersibility evaluating method described in Comparative Example 1. The layer separation ratio was found to be 5%. The lower layer lacked fluidity, in which particles were densely accumulated and could not readily be redispersed.

When the electroviscous fluid was heated to 100° C., it was thermally set in 20 minutes, whereas the electroviscous fluid in Example 1 was not thermally set even after 180 minutes had elapsed.

EXAMPLE 6

Silica particles in which the number of esterified silanol groups bonded to the particle surface was in the range of from 2.7 to 3.3/nm$^2$ were obtained in the same way in Example 2 except that the silica particles in Example 2 were replaced by "Sylysia 310" (manufactured by Fuji Silysia (k.k.); average particle diameter: 1.4 μm), and that 1-octanol ($C_8H_{17}OH$), lauryl alcohol ($C_{12}H_{25}OH$), oleyl alcohol ($C_{18}H_{35}OH$), 1-tetracosanol ($C_{24}H_{49}OH$), 1-dotriacontanol ($C_{32}H_{65}OH$), and 1-hexatriacontanol ($C_{36}H_{73}OH$) were respectively used in the same amount as an alcohol.

Electroviscous fluids were prepared by using the silica particles thus obtained in the same way as in Example 1. Thereafter, for each electroviscous fluid, the effect of the main chain length of the alkyl group in the alcohol on the dispersibility of the silica fine particles and on the electroviscous effect (viscosity increase factor) was evaluated in the same way as in Example 3.

Figure 7:
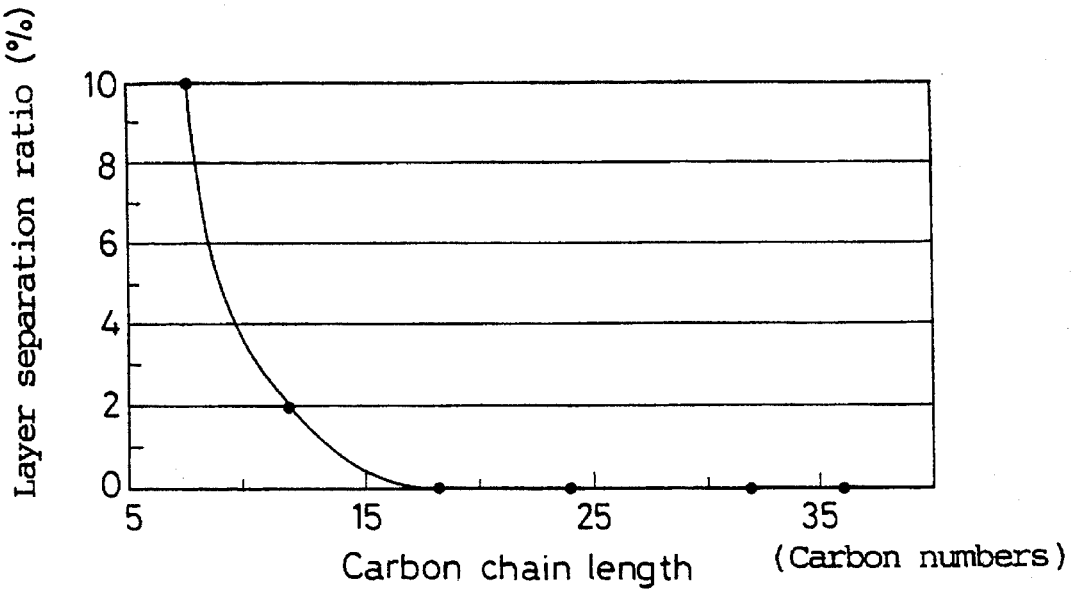
FIG. 7 is a graph showing the relationship between the main chain length of an alkyl group in an alcohol used to esterify silica fine particle surfaces and the layer separation ratio in the electroviscous fluid.
Figure 8:
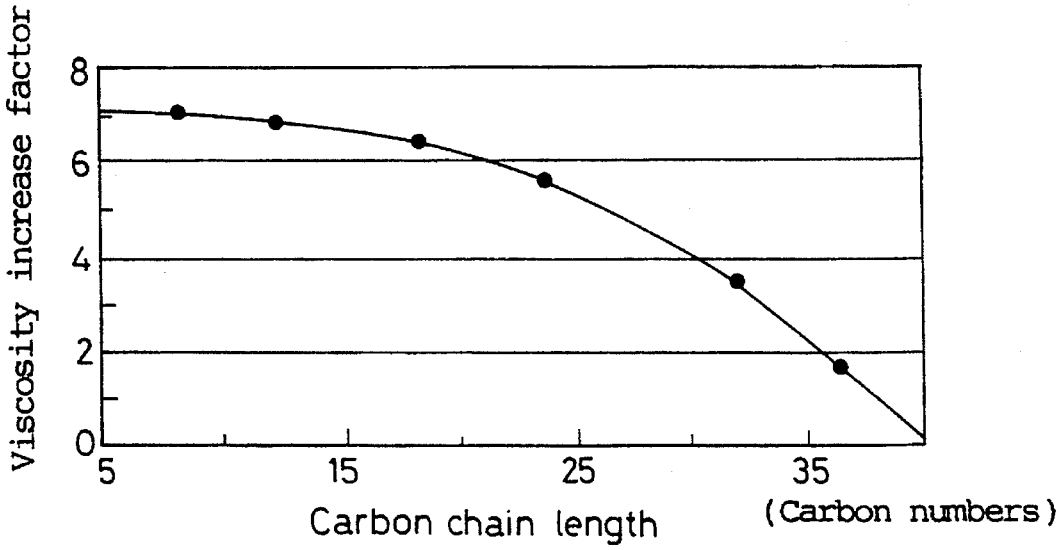
FIG. 8 is a graph showing the relationship between the main chain length of an alkyl group in an alcohol used to esterify silica fine particle surfaces and the viscosity increase factor in the electroviscous fluid.

FIG. 7 shows the results of measurement for dispersibility, and FIG. 8 shows the results of measurement for the viscosity increase factor.

As shown in FIG. 7, layer separation occurred only when 1-octanol (number of carbon atoms: 8) or lauryl alcohol (number of carbon atoms: 12) was used for esterification. However, the lower layer that was separated was readily redispersed by slight vibration.

It will also be understood from FIG. 8 that viscosity increase effect can be obtained by carrying out esterification using an alcohol having an alkyl group with from 8 to 36 carbon atoms. That is, it will be understood from FIGS. 7 and 8 that as the number of carbon atoms increases, the dispersion stability becomes excellent, as shown in FIG. 7, but the viscosity increase effect reduces, as shown in FIG. 8.

When an alcohol having an alkyl group with less than 8 carbon atoms was used for esterification, the speed of layer separation was unfavorably high. Therefore, the viscosity increase effect was not stabilized, and evaluation could not be made.

Industrial Applicability

The electroviscous fluid of the present invention can be effectively used for electric control of a variable damper, an engine mount, a bearing damper, a clutch, a valve, a shock absorber, a display device, etc.

What is claimed is:

1. A non-aqueous electroviscous fluid characterized in that an electrically insulating fluid is mixed with silica fine particles each having a surface esterified with a monohydric alcohol having an alkyl group with 8 or more carbon atoms as a main chain, said electrically insulating fluid being, said electroviscous fluid containing said silica fine particles in an amount of 0.1 to 50 weight % and containing said polyhydric alcohol in an amount of 2 to 80 weight % with respect to said silica fine particles.

2. A non-aqueous electroviscous fluid according to claim 1, wherein said monohydric alcohol has an alkyl group with from 8 to 48 carbon atoms as a main chain.

3. A non-aqueous electroviscous fluid according to claim 1, wherein said silica fine particles have a particle diameter in the range of from 0.01 μm to 4.0 μm.

4. A non-aqueous electroviscous fluid according to claim 1, wherein said silica fine particles have a particle diameter in the range of from 0.01 μm to 1.5 μm.

5. A non-aqueous electroviscous fluid according to claim 1, wherein said silica fine particles have a particle diameter in the range of from 0.01 μm to 0.5 μm.

6. A non-aqueous electroviscous fluid according to claim 1, wherein said silica fine particles have a particle diameter in the range of from 0.5 μm to 4.0 μm, and said monohydric alcohol has a straight-chain alkyl group with from 12 to 48 carbon atoms as a main chain.

7. A non-aqueous electroviscous fluid according to claim 1, wherein said silica fine particles have a particle diameter in the range of from 0.01 μm to 0.5 μm, and said monohydric alcohol has a straight-chain alkyl group with from 8 to 32 carbon atoms as a main chain.

8. A non-aqueous electroviscous fluid according to claim 1, wherein the number of esterified silanol groups bonded to the silica fine particle surface is in the range of from 1.8/nm$^2$ to 6.0/nm$^2$.

9. A non-aqueous electroviscous fluid according to claim 1, wherein the number of esterified silanol groups bonded to the silica fine particle surface is in the range of from 2.0/nm$^2$ to 5.5/nm$^2$.

10. A non-aqueous electroviscous fluid characterized in that an electrically insulating fluid is mixed with silica fine particles each having a particle size of 0.5 to 4.0/μm and having a surface esterified with a monohydric alcohol where a straight chain alkyl group with 12 to 48 carbon atoms is directly bonded to a hydroxyl group, said electroviscous fluid containing said silica fine particles in an amount of 0.1 to 50 weight % and containing a polyhydric alcohol in an amount of 2 to 80 weight % with respect to said silica fine particles.

11. A non-aqueous electroviscous fluid characterized in that an electrically insulating fluid is mixed with silica fine particles each having a particle size of 0.01 to 0.5/μm and having a surface esterified with a monohydric alcohol where a straight chain alkyl group with 8 to 32 carbon atoms is directly bonded to a hydroxyl group, said electroviscous fluid containing said silica fine particles in an amount of 0.1 to 50 weight % and containing a polyhydric alcohol in an amount of 2 to 80 weight % with respect to said silica fine particles.

12. A non-aqueous electroviscous fluid according to claim 2, wherein a number of bonding groups of silanol group esterified on the surface of the silica fine particles is 2.0 to 5.5/nm$^2$.

* * * * *

UNITED STATES PATENT AND TRADEMARK OFFICE

CERTIFICATE OF CORRECTION

PATENT NO.: 5,603,861
DATED : February 18, 1997
INVENTOR(S): UMAMORI, et al.

It is certified that error appears in the above-identified patent and that said Letters Patent is hereby corrected as shown below:

On the Title Page item [75], the City is incorrect, delete "Ohigmachi" and insert therefor, --Ohi--

Signed and Sealed this

Fifteenth Day of July, 1997

Bruce Lehman

*Attest:*

BRUCE LEHMAN

*Attesting Officer*

*Commissioner of Patents and Trademarks*